US011300019B2

(12) United States Patent
Granottier et al.

(10) Patent No.: US 11,300,019 B2
(45) Date of Patent: Apr. 12, 2022

(54) NOZZLE FOR COOLING ENGINE PISTONS

(71) Applicant: VOLVO TRUCK CORPORATION, Gothenburg (SE)

(72) Inventors: Nicolas Granottier, Lyons (FR); Catherine Cuinier, Saint Maurice de Gourdans (FR)

(73) Assignee: VOLVO TRUCK CORPORATION, Gothenburg (SE)

( * ) Notice: Subject to any disclaimer, the term of this patent is extended or adjusted under 35 U.S.C. 154(b) by 93 days.

(21) Appl. No.: 16/616,695

(22) PCT Filed: Jul. 7, 2017

(86) PCT No.: PCT/IB2017/001041
§ 371 (c)(1),
(2) Date: Nov. 25, 2019

(87) PCT Pub. No.: WO2019/008409
PCT Pub. Date: Jan. 10, 2019

(65) Prior Publication Data
US 2021/0246815 A1 Aug. 12, 2021

(51) Int. Cl.

| | |
|---|---|
| ***F01M 1/08*** | (2006.01) |
| ***F01P 3/08*** | (2006.01) |
| ***F01M 1/16*** | (2006.01) |
| ***F01P 3/10*** | (2006.01) |
| ***F01P 3/00*** | (2006.01) |

(52) U.S. Cl.
CPC ..... *F01M 1/08* (2013.01); *F01P 3/08* (2013.01); *F01M 1/16* (2013.01); *F01M 2001/083* (2013.01); *F01P 3/10* (2013.01); *F01P 2003/006* (2013.01)

(58) Field of Classification Search
CPC ..... F01P 3/10; F01P 3/08; F01M 1/16; F01M 2001/083
See application file for complete search history.

(56) References Cited

FOREIGN PATENT DOCUMENTS

| | | | | |
|---|---|---|---|---|
| DE | 102015107078 | A1 * | 11/2015 | ..... F01P 3/08 |
| DE | 102015107078 | A1 | 11/2015 | |
| DE | 102017201905 | A1 * | 3/2018 | ..... F16K 11/07 |
| EP | 0947285 | A1 | 10/1999 | |
| GB | 2431217 | A | 4/2007 | |

OTHER PUBLICATIONS

International Search Report and Written Opinion in corresponding International Application No. PCT/IB2017/001041 dated Nov. 8, 2017 (7 pages).

* cited by examiner

*Primary Examiner* — Kevin A Lathers
(74) *Attorney, Agent, or Firm* — Venable LLP; Jeffri A. Kaminski

(57) ABSTRACT

The present invention relates to a cooling jet nozzle (10) for an engine piston. The nozzle (10) comprises a cooling stream pathway (14), in which the internal cross-sectional dimensions of the pathway vary along the length of the pathway; and a plunger (28) located within the cooling stream pathway to impinge a cooling feedstream received within the pathway to provide a cooling jet. The plunger (28) is axially moveable within the pathway to adjust the internal cross-sectional dimensions of the cooling jet.

16 Claims, 3 Drawing Sheets

NOZZLE FOR COOLING ENGINE PISTONS

CROSS-REFERENCE TO RELATED APPLICATIONS

This application is a U.S. National Stage application of PCT/IB2017/001041, filed Jul. 7, 2017 and published on Jan. 10, 2019 as WO/2019/008409, all of which is hereby incorporated by reference in its entirety.

TECHNICAL FIELD

The present invention relates to a cooling jet nozzle, in particular to an oil jet nozzle, for cooling an engine piston. The present invention also relates to an engine comprising at least one cooling jet nozzle for cooling at least one engine piston. The present invention also relates to a method for cooling an engine, and in particular to a method for providing a cooling jet having a predetermined speed and/or pressure.

The invention can be applied in vehicles having internal combustion engine, such as trucks, buses and construction equipment.

BACKGROUND

During operation, the pistons of an engine become heated. In order to provide efficient running of the engine, it is beneficial to cool the pistons. Conventionally, oil jets may be used to help cool the pistons. Oil jets are typically sprayed into channels on the underside of the pistons during operation of the engine in order to cool the pistons, which in turn lowers the temperature of the combustion chamber. As a result, the oil jets improve the efficiency of the engine, and help the engine to generate more power whilst also lubricating the pistons which increases durability and lifetime of the engine.

In order to provide adequate cooling to the pistons, the oil jet is required to be provided to the piston at a sufficiently high jet speed. In particular, the oil jet is required to be provided at a jet speed which is at least equal to the speed of the piston. The jet speed is however dependent on oil flow rate (ie. on the pump speed) which is itself dependent on the engine speed. At high engine speeds, the oil flow rate is increased compare to flow rate at low engine speed, however the speed of the oil jet is not proportionally increased with speed of the piston. That's why, at high engine speed, speed of the oil jet can be insufficient in order to provide adequate cooling of the pistons. It is therefore difficult for conventional jet nozzles to provide an oil jet which can be used to efficiently cool pistons over a range of engine speeds, in particular at high speeds.

SUMMARY

An object of embodiments of the present invention is to provide a nozzle which is capable of providing a cooling jet, for example an oil jet, to provide efficient cooling of the pistons of an engine over a range of engine speeds, especially at high speeds.

A further object of embodiments of the present invention is to provide a jet nozzle capable of providing a cooling jet, for example an oil jet, having predetermined jet speed and/or pressure which can be achieved independent of the flow rate of the cooling stream.

A further object of embodiments of the present invention is to provide a jet nozzle which is capable of being adjusted to only provide the required cooler jet, or oil jet, having a predetermined jet speed and/or pressure as and when needed in order to provide a more economical and efficient cooling system.

According to a first aspect of the invention, at least some of these objects may be achieved by a cooling jet nozzle for cooling an engine piston, in which the nozzle comprises:

- a cooling stream pathway, in which the internal cross-sectional dimensions of the pathway vary along the length of the pathway; and
- a plunger located within the cooling stream pathway to impinge a cooling feedstream received within the pathway to provide a cooling jet, characterized in that the plunger is axially moveable in order to adjust the internal cross-sectional dimensions of the cooling jet.

In one embodiment, the plunger is axially moveable within the pathway in response to the pressure of the cooling feedstream. For example the plunger may move in direct response to the pressure.

By the provision of a cooling jet nozzle having a pathway in which the internal cross-sectional dimensions of the pathway vary along the length of the pathway together with an axially moveable plunger within the pathway, the nozzle can provide a cooling jet having the necessary speed and/or pressure and/or volume over a range of different operation parameters of the engine in order to provide improved and efficient cooling of the pistons.

According to one embodiment, the cooling stream pathway is preferably in communication with and extending between a cooling stream inlet and a cooling jet outlet. The inlet and outlet are preferably aligned axially and provided at opposite ends of the nozzle.

The cooling stream inlet is preferably in communication with a cooling feedstream source.

According to one embodiment, the plunger is preferably located at or adjacent the cooling jet nozzle outlet. In one embodiment, the plunger is located substantially centrally within the pathway. In particular, the plunger is located substantially centrally between the opposing walls forming the pathway within the nozzle.

The plunger is preferably axially moveable in a direction extending substantially parallel to the direction of flow of the cooling feedstream, in particular to the direction of flow of the cooling feedstream from the inlet towards the outlet. In one embodiment, the nozzle may comprise an elongate cooling stream pathway extending between a cooling feedstream inlet and the cooling jet outlet. The plunger is preferably axially moveable in a direction extending substantially parallel to the longitudinal axis of the elongate cooling stream pathway.

The plunger is preferably moveable between a first open position to provide a first cooling jet having a first internal cross-sectional dimension, and at least a second open position to provide a second cooling jet having a second internal cross-sectional dimension. The first internal cross-sectional dimension of the cooling jet is greater than the second internal cross-sectional dimension of the cooling jet.

The term "internal cross-sectional dimension of the cooling jet" is used herein to refer to the cross-sectional surface area of the cooling jet when generated within the cooling stream pathway of the nozzle.

According to one embodiment, the plunger is resiliently biased away from the nozzle outlet. For example, the plunger is preferably resiliently biased towards the first open position. The nozzle may further comprise a resilient biasing member, such as for example a spring, arranged to resiliently bias the plunger away from the nozzle outlet towards the first open position. The resilient biasing member, for example a spring, is preferably located at or adjacent the outlet.

The pathway may be provided by a first cylindrical pathway portion in communication with a second cylindrical pathway portion. The first and second cylindrical pathway portions may be aligned axially. The second cylindrical portion may provide the jet nozzle outlet. The first cylindrical pathway portion may provide the inlet for the cooling feedstream. The first cylindrical pathway portion may have a first internal cross-sectional dimension and the second cylindrical pathway portion may have a second internal cross-sectional dimension. There is preferably a variation between the first and second internal cross-sectional dimensions. In the latter case, the first internal cross-sectional dimension of the first cylindrical pathway portion is preferably greater than the second internal cross-sectional dimension of the second cylindrical pathway portion.

According to one embodiment, the plunger may be moveable between a first open position in which the plunger is located within the first cylindrical pathway portion to provide a first cooling jet having a first internal cross-sectional dimension within the second cylindrical pathway portion, and a second open position in which the plunger is at least partially engaged within the second cylindrical pathway portion to provide a second cooling jet having a second internal cross-sectional dimension within the second cylindrical pathway portion. The first internal cross-sectional dimension of the first cooling jet is greater than the second internal cross-sectional dimension of the second cooling jet. In the first open position, the plunger is preferably totally engaged within the first cylindrical pathway portion According to one embodiment, the plunger may be moveable between a first open position in which the plunger is located within the first cylindrical pathway portion to provide a first cooling jet having a first internal cross-sectional dimension within the second cylindrical pathway portion, and a second open position in which the plunger is totally engaged within the second cylindrical pathway portion to provide a second cooling jet having a second internal cross-sectional dimension within the second cylindrical pathway portion. The first internal cross-sectional dimension of the first cooling jet is greater than the second internal cross-sectional dimension of the second cooling jet.

According to one embodiment, the plunger has an elongate portion having a longitudinal axis which is substantially aligned with the longitudinal axis of the pathway. The plunger may comprise a tapered profile. The plunger may taper along the length of the plunger, or it may comprise a tapered portion. The cross-sectional dimensions of the plunger, or tapered portion of the plunger, preferably increases in a direction extending substantially parallel to the direction of flow of the cooling jet. For example, the plunger or a portion of the plunger may taper inwardly from a first end located adjacent the outlet of the pathway towards a second opposed end.

According to the latter embodiment, the plunger is movable between the first open position and the second open position such that in the second open position of the plunger at least a portion of the plunger having the greatest outside diameter is engaged within the second cylindrical pathway.

The plunger has a first axial end located on the side of the jet nozzle outlet and the jet nozzle outlet has an inside diameter. In a preferred embodiment of the invention, in the second open position of the plunger, the first axial end of the plunger is located at a distance from the jet outside outlet that is inferior to one-half of the inside diameter of the jet nozzle outlet. More preferably, the first axial end of the plunger is located at a distance from the jet outside outlet that is inferior to one-quarter of the inside diameter of the jet nozzle outlet. The distance between the first axial end of the plunger and the jet outside outlet is measured in the direction of flow of the cooling jet, that is to say along the longitudinal axis of the plunger or of the pathway.

The nozzle is preferably an oil jet nozzle.

According to a second aspect of the present invention, at least some of the objects may be achieved by an engine comprising at least one engine piston and at least one cooling jet nozzle as herein described, in which each piston is in communication with a cooling jet outlet of a nozzle.

According to a third aspect of the present invention, at least some of the objects may be achieved by a method for providing a cooling jet having a predetermined speed and/or pressure, the method characterized by the steps of:

- feeding a cooling feedstream into the cooling stream pathway of a nozzle as described herein; and
- generating a cooling jet having a predetermined speed and/or pressure within the pathway of the nozzle, in which the cooling jet has an internal cross-sectional dimension which is dependent on the location of the plunger within the pathway.

According to a fourth aspect of the present invention, at least some of the objects may be achieved by a method for reducing the temperature of at least one engine piston, the method characterized by the steps of:

- feeding a cooling feedstream into the pathway of a nozzle as described herein;
- generating a cooling jet having a predetermined speed and/or pressure within the pathway of the nozzle, in which the cooling jet has an internal cross-sectional dimension which is dependent on the location of the plunger within the pathway; and
- using the cooling jet having a predetermined speed and/or pressure to reduce the temperature of at least one engine piston.

The location of the plunger within the pathway may be dependent on the pressure of the cooling feedstream.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS OF THE INVENTION

Figure 1:
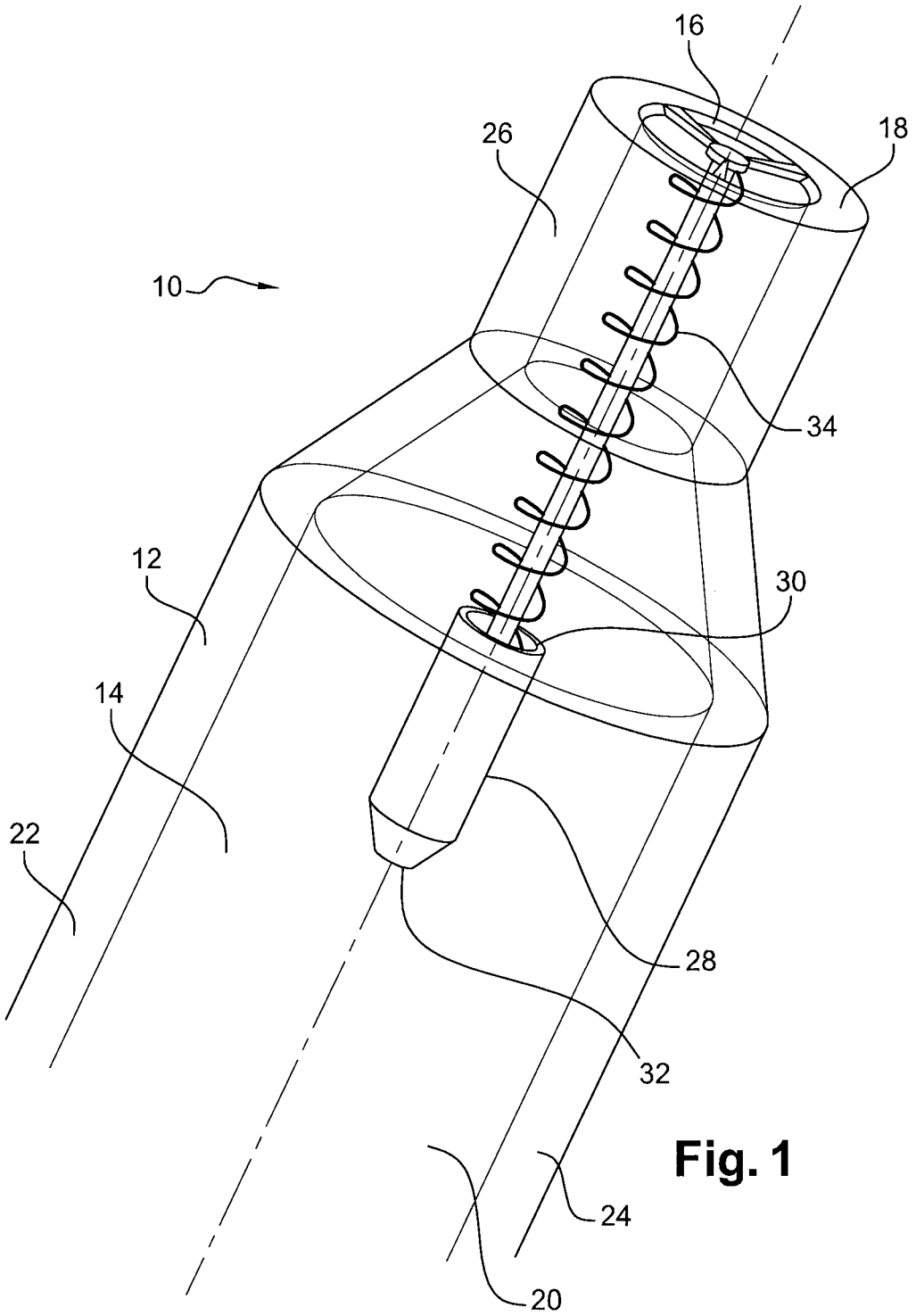
FIG. 1 is a schematic illustration of a perspective view of a cooling jet nozzle according to one embodiment of the present invention.
Figure 2:
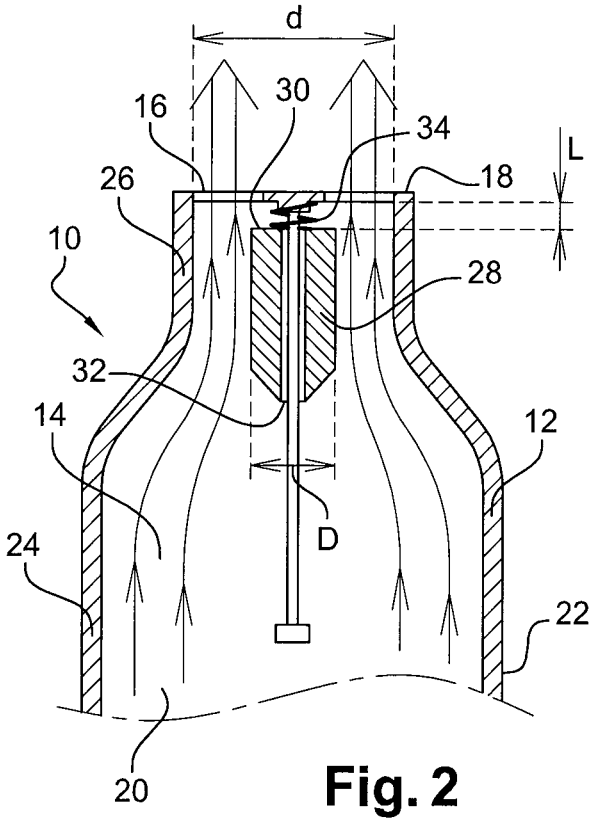
FIG. 2 is a schematic illustration of a cross-sectional view of a cooling jet nozzle of FIG. 1 when the plunger is in the second open position.
Figure 3:
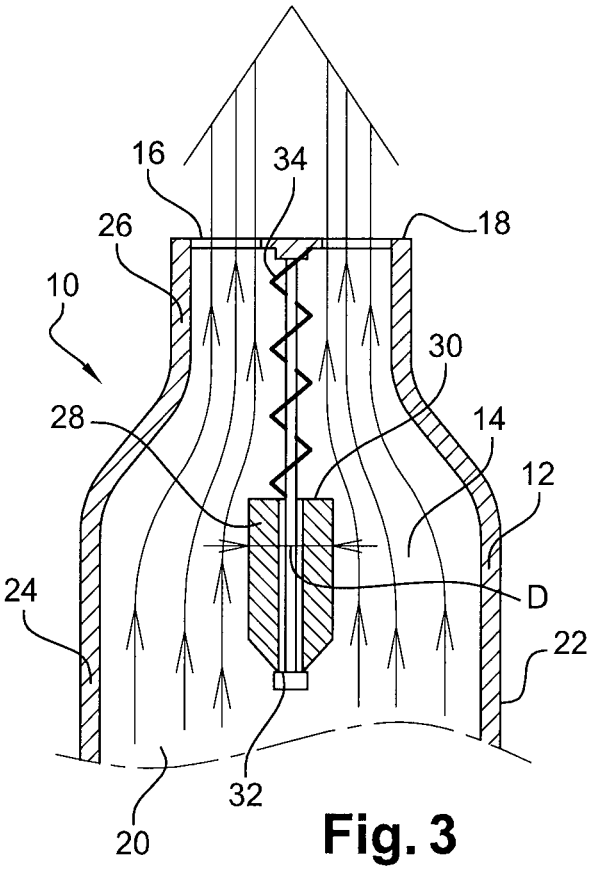
FIG. 3 is a schematic illustration of a cross-sectional view of a cooling jet nozzle of FIG. 1 when the plunger is in the first open position.

With reference to FIGS. 1 to 3, according to an illustrated embodiment of the present invention, the cooling jet nozzle 10, comprises an elongate cylindrical portion 12 comprising an internal cooling stream pathway 14. The internal cooling stream pathway 14 extends between a cooling feedstream inlet 20 provided at a first end 22 and a cooling jet outlet 16 located at a second opposed end 18 of the cylindrical portion 12.

The inlet 20 and the outlet 16 are both substantially circular in shape and are aligned axially with each other. The longitudinal axis of the pathway 14, is aligned with the centre of each of the inlet 20 and the outlet 16 and extends there between. It is however to be understood that the pathway 14 may extend in any suitable direction and is not limited to the illustrated embodiment in which the pathway 14 extends axially between the inlet 20 and the outlet 16.

The internal cooling stream pathway 14 comprises a first cylindrical pathway portion 24 and a second cylindrical pathway portion 26. The second cylindrical pathway portion 26 provides the nozzle outlet 16. The second cylindrical pathway portion 26 provides the feedstream inlet 20. The first and second cylindrical pathway portions 24 and 26 are aligned axially and are in communication with each other to provide the pathway 14. The longitudinal axis of the pathway 14 extends through the centre points of each of the first and second cylindrical pathway portions 24, 26.

In the embodiment illustrated in FIGS. 1 to 3, the first pathway portion 24 has internal transverse cross-sectional dimensions A-A' which are greater than the internal transverse cross-sectional dimensions B-B' of the second pathway portion 26.

The pathway of the nozzle of the present invention as shown in FIGS. 1 to 3 provides a stepped variation in cross-sectional dimensions along the length of the pathway. It is to be understood that the pathway may include any number of pathway portions providing any number of variations in the transverse cross-sectional dimensions of the pathway at any suitable location along the length of the pathway.

The nozzle of the present invention 10 further comprises a plunger 28 located within the pathway 14 of the elongate cylindrical portion 12.

The plunger 28 is located adjacent the cooling jet outlet 16 at the second end 18 of the cylindrical portion 12. The plunger 28 is located substantially centrally between the opposed walls forming the pathway 14 within the cylindrical portion 12. The plunger 28 is axially moveable within the pathway 14 of the cylindrical portion 12.

As shown in FIGS. 1 to 3, the plunger 28 has a first end 30 located adjacent the second end 18 of the cylindrical portion 12. The plunger 28 has an opposed second end 32 located towards the first end 20 of the cylindrical portion 12. It can be seen from FIGS. 1 to 3 that the plunger 28 is elongate in form. The longitudinal axis of the plunger 28 is aligned with the longitudinal axis of the pathway 14. The plunger 28 has a substantially cylindrical shape which tapers inwardly towards the second end 32 of the plunger 28. It is to be understood that the plunger may have any suitable shape and is not limited to being substantially cylindrical in shape with a tapered end. The plunger 28 may for example taper inwardly along substantially the entire length of the plunger 28 from the first end 30 3 towards the second end 32.

As can be seen from FIGS. 2 and 3, the plunger 28 is axially moveable within the pathway 14. In particular, the plunger 28 is axially moveable within the pathway 14 in a direction extending substantially parallel to the longitudinal axis of the pathway 14 and the longitudinal axis of the plunger elongate cylindrical portion 12. The plunger 28 is axially moveable within the pathway 14 in a direction extending substantially parallel to the direction of flow of the cooling feedstream supplied to the inlet 20 of the elongate cylindrical portion 12.

The nozzle 10 further comprises a spring member 34 located adjacent the jet outlet 16, at the first end 18 of nozzle 10. It is to be understood that the spring member may be any resilient biasing member arranged to bias the plunger 28 in a direction towards the first pathway portion 24.

Prior to the supply of a cooling feedstream to the nozzle of the invention, the spring 34, provides sufficient biasing force to the first end 30 of the plunger 28 to ensure that the plunger 28 is located within the first cylindrical pathway portion 24 of the pathway 14. This position is herein referred to as the first open position.

Figure 4:
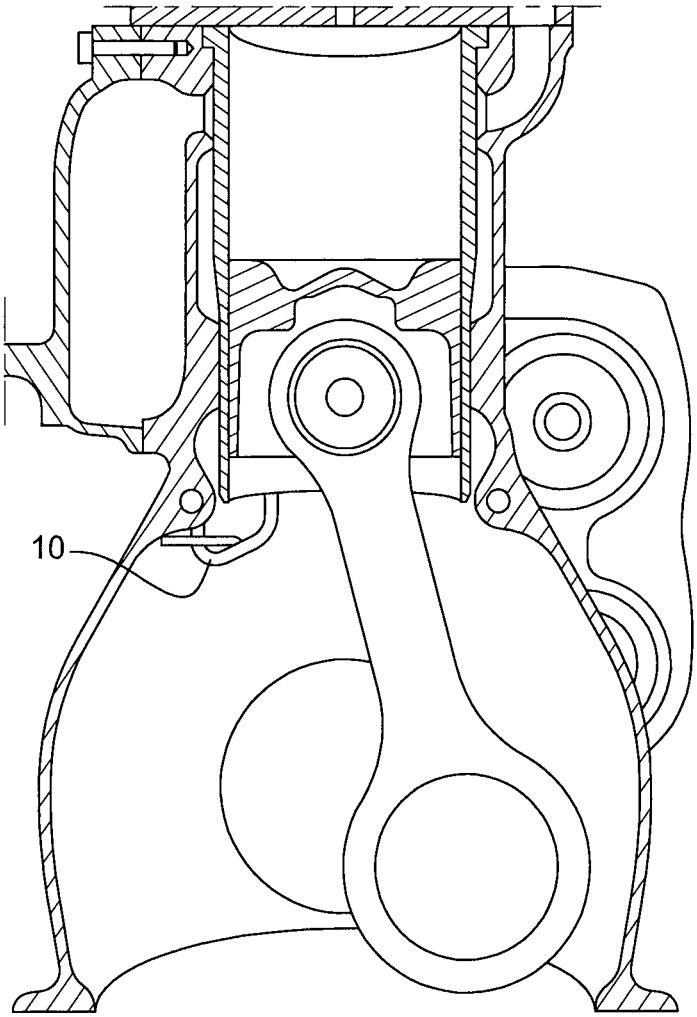
FIG. 4 is a schematic illustration of the location of the cooling jet nozzle of the present invention in relation to the piston of an engine.
Figure 5:
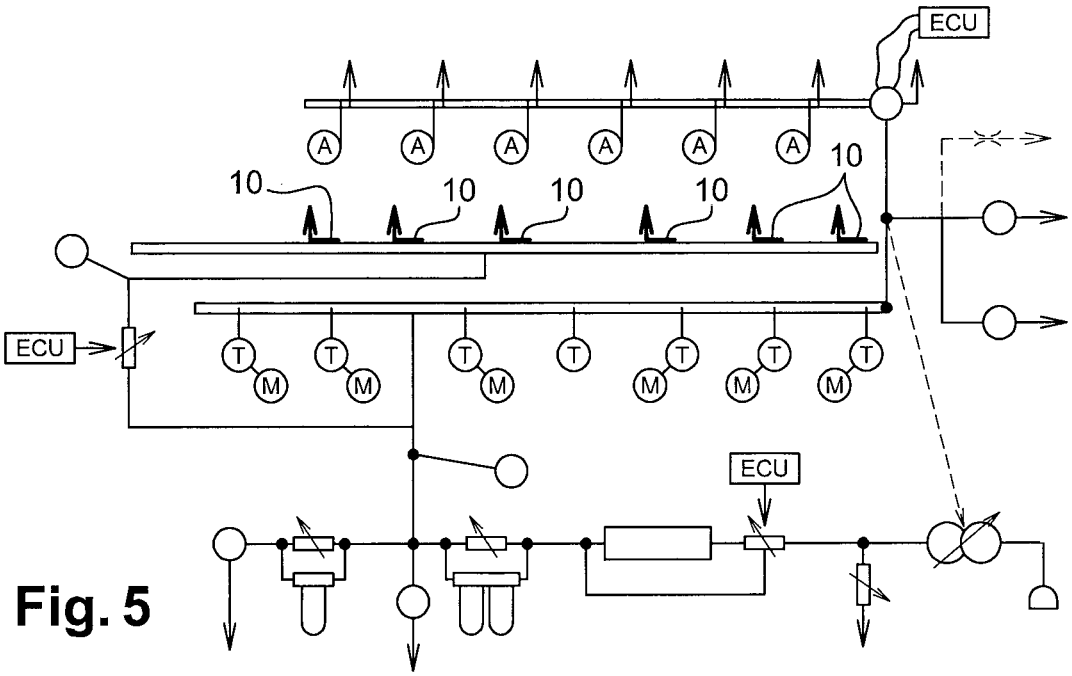
FIG. 5 is a further schematic illustration of the location of the cooling jet nozzle of the present invention in relation to the pistons of an engine.

As shown in FIGS. 4 and 5, the cooling jet nozzle of the present invention is located adjacent a piston of the engine. Preferably, the engine comprises a plurality of cooling jet nozzles 10 such that each cooling jet nozzle is located adjacent a separate piston of the engine.

In use, a cooling feedstream, is provided through the feedstream inlet 20 and into the cooling stream pathway 14 of the nozzle 10 of the present invention. The cooling feedstream is preferably oil. It is however to be understood that the feedstream may comprise any suitable coolant and is not to be limited to oil.

As the cooling feedstream passes through the pathway 14, it impinges on the second end 32 of the plunger 28 which is located in the second open position. The force experienced by the plunger 28 during impingement depends on the flow rate of the cooling feedstream. The force imparted to the second end 32 of the plunger 28, by the impact of the feedstream may be sufficient to cause axial movement of the plunger 28 towards the nozzle outlet 16.

As shown in FIGS. 1 and 3, when the engine is operating at a low speed, the oil is provided at a low speed into the pathway 14 of the nozzle 10. Due to the low speed of the feedstream, the force provided on impingement with the plunger 28 is too low to overcome the biasing force provided by the spring 34 in order to cause the plunger 28 to move beyond the first cylindrical portion 24. The plunger 28 therefore remains in the first open position within the first cylindrical portion 24. As the oil impinges the plunger 28 a first oil jet is formed within the second cylindrical pathway portion 26.

In contrast, as shown in FIG. 2 when the engine is operating at a high speed, the oil is provided at a high speed into the pathway 14 of the nozzle 10. As the oil impinges, the force provided on impingement with the plunger 28 is sufficient to overcome the biasing force provided by the spring 34 and therefore causes axial movement of the plunger 28 in a direction extending substantially parallel to the direction of flow of the cooling feedstream. On impingement with the feedstream, the plunger 28 moves in the direction of the feedstream towards the nozzle outlet 16. The plunger 28 is therefore moved from the first open position within the first cylindrical pathway portion 24 up to a position wherein the plunger 28 is engaged within second cylindrical pathway portion 26. This position, as shown in FIG. 2, is referred to as the second open position of the plunger. In the second open position of the plunger, a second oil jet is formed within the second cylindrical pathway portion 26.

The second oil jet (produced when the engine is operating at a high speed, FIG. 2) has, within the second cylindrical pathway portion 26, a reduced internal cross-sectional dimension than the first oil jet (produced within the second cylindrical pathway portion 26 when the engine is operating at a low speed; FIG. 3). In the second open position, the jet velocity and/or pressure obtained from a given velocity feedstream is increased by reducing the cross-sectional dimensions at the point of jet formation. By ensuring that the cross-sectional dimensions of the pathway at the point of forming the jet, i.e. within the second cylindrical pathway portion 26, are reduced above a given flow rate, and thereby producing within the second cylindrical pathway portion 26 a second oil jet with reduced cross-sectional dimensions when compared to the first oil jet, the nozzle ensures that a jet with sufficient jet speed can be produced when the engine is operating at a high speed.

In other words, when the engine is operating at high speeds, the nozzle is able to ensure the production of an oil jet (the second oil jet) with smaller internal cross-sectional dimensions than the first oil jet produced at low speeds, in order to provide a second oil jet which has a higher jet speed than the first oil jet produced at low speeds.

In the second open position of the plunger 28 such as represented on FIG. 2, the plunger is at least partially engaged within the second cylindrical pathway 26. On the embodiment of FIGS. 1 to 3, the cross-sectional diameter of the plunger 28 increases in a direction extending substantially parallel to the direction of flow of the cooling jet. Preferably and such as represented on FIG. 2, in order to obtain a beneficial effect on the speed of the second oil jet at least a portion of the plunger 28 having the greatest outside diameter G is engaged within the second cylindrical pathway 26. In a variant, wherein the plunger is in the second open position, the plunger 28 can be totally engaged within the second cylindrical pathway 26.

In a preferred arrangement of the invention, in the second open position of the plunger 2 28 such as represented on FIG. 2, the first end 30 of the plunger 28 is located at a distance L from the jet outside outlet 16 with the distance L that is inferior to one-half of the inside diameter d of the jet nozzle outlet 16. More preferably, the first axial end 30 of the plunger is located at a distance L from the jet outside outlet that is inferior to one-quarter of the inside diameter d of the jet nozzle outlet 16. The distance L between the first axial end of the plunger and the jet outside outlet is measured in the direction of flow of the cooling jet, that is to say along the longitudinal axis of the plunger 28 or of the pathway 14. The distance L between the first end 30 of the plunger 28 and the jet outside outlet should be as shorter as possible to limit loss of speed of the jet between the first end 30 of the plunger and the jet outside outlet 16. A distance L that is inferior to one-half of the inside diameter d of the jet nozzle outlet 16 has few impact on the speed of the jet that comes out of the cooling jet nozzle 16.

The location of the plunger within the pathway 14 of the nozzle is described as being directly dependent on the pressure of the incoming cooling feedstream (in that the feedstream acts directly against the biasing spring to move the plunger). However, the skilled person will understand that the position could be indirectly controlled. For example by adjustment mechanism in response to the cooling requirements of the engine. For example the feedstream pressure could be sensed and provided to a control system which adjusts the position of the plunger.

The nozzle of the present invention is therefore able to provide cooling jets for an engine operating over a range of different conditions having improved jet velocity and/or pressure and/or cross-sectional dimensions, in particular transverse cross-sectional dimensions.

The nozzle of the present invention is therefore able to provide improved and more efficient cooling of pistons of an engine over a range of different operating conditions.

It is to be understood that the present invention is not limited to the embodiments described above and illustrated in the drawings; rather, the skilled person will recognize that many changes and modifications may be made within the scope of the appended claims.

The invention claimed is:

1. A cooling jet nozzle for an engine piston, in which the cooling jet nozzle comprises: a cooling stream pathway, in which internal cross-sectional dimensions of the pathway vary along a length of the pathway; and a plunger located within the cooling stream pathway to impinge a cooling feedstream received within the pathway to provide a cooling jet, characterized in that the plunger is axially moveable in order to adjust the internal cross-sectional dimensions of the cooling jet;

wherein the cooling stream pathway is provided by a first cylindrical pathway portion in communication with a second cylindrical pathway portion, in which the second cylindrical pathway portion provides a jet nozzle outlet, the plunger is moveable between a first open position in which the plunger is located within the first cylindrical pathway portion to provide a first cooling jet, and a second open position in which the plunger is at least partially engaged within the second cylindrical pathway portion to provide a second cooling jet stream, wherein the plunger has a first axial end located on a side of the jet nozzle outlet; the jet nozzle outlet has an inside diameter, and in the second open position of the plunger, said first axial end is located at a distance from the jet nozzle outside outlet that is less than one-half of said inside diameter, said distance is inferior to one-quarter of said inside diameter wherein said distance is measured in a direction of flow of the cooling jet.

2. A nozzle as claimed in claim 1, characterized in that the plunger is located at or adjacent the jet nozzle outlet.

3. A nozzle as claimed in claim 1, characterized in that the plunger is located substantially centrally between opposing walls forming the pathway.

4. A nozzle as claimed in claim 1, characterized in that the plunger is axially moveable in a direction extending substantially parallel to the direction of flow of the cooling feedstream.

5. A nozzle as claimed in claim 1, characterized in that the plunger is moveable between a first open position to provide a first cooling jet having a first internal cross-sectional dimension, and at least a second open position to provide a second cooling jet having a second internal cross-sectional dimension, and in which the first internal cross-sectional dimension is greater than the second internal cross-sectional dimension.

6. A nozzle as claimed in claim 5, characterized in that the plunger is resiliently biased towards the first open position.

7. A nozzle as claimed in claim 6, characterized in that the nozzle further comprises a resilient biasing member arranged to resiliently bias the plunger in a direction towards the first open position.

8. A nozzle as claimed in claim 1, characterized in that the first cylindrical pathway portion has a first internal cross-sectional dimension, and in which the second cylindrical pathway portion has a second internal cross-sectional dimension, in which the first internal cross-sectional dimension is greater than the second internal cross-sectional dimension.

9. A nozzle as claimed in claim 8, characterized in that the first cooling jet has a first internal cross-sectional dimension within the second cylindrical pathway portion, the second cooling jet stream has a second internal cross-sectional dimension within the second cylindrical pathway portion, in which the first internal cross-sectional dimension is greater than the second internal cross-sectional dimension.

10. A nozzle as claimed in claim 9, characterized in that in the second open position, the plunger is totally engaged within the second cylindrical pathway to provide the second cooling jet stream.

11. A nozzle according to claim 9, characterized in that, in the second open position of the plunger, at least a portion of the plunger having the greatest outside diameter is engaged within the second cylindrical pathway.

12. A nozzle as claimed in claim 1, characterized in that cross-sectional dimensions of the plunger increase in a direction extending substantially parallel to the direction of flow of the cooling jet.

13. A nozzle as claimed in claim 1, characterized in that the nozzle is an oil jet nozzle.

14. An engine comprising at least one engine piston and at least one nozzle as claimed in claim 1, in which each piston is in communication with a cooling jet outlet of a nozzle.

15. A method for providing a cooling jet having a predetermined speed and/or pressure characterized by the steps of: feeding a cooling stream into the cooling stream pathway of a nozzle as claimed in claim 1; and generating a cooling jet having a predetermined speed within the pathway of the nozzle, in which the cooling jet has an internal cross-sectional dimension which is dependent on the location of the plunger within the pathway.

16. A method for cooling at least one engine piston characterized ley the steps of: feeding a cooling stream into the cooling stream pathway of a nozzle as claimed in claim 1; generating a cooling jet having a predetermined speed and/or pressure within the pathway of the nozzle, in which the cooling jet has an internal cross-sectional dimension which is dependent on the location of the plunger within the pathway; and using the cooling jet having a predetermined speed and/or pressure to cool at least one engine piston.

* * * * *